US005148597A

United States Patent [19]

Weeks

[11] Patent Number: 5,148,597

[45] Date of Patent: Sep. 22, 1992

[54] METHOD OF MAKING A COLLECTOR DEVICE

[75] Inventor: Andrew M. Weeks, Jackson, Mich.

[73] Assignee: Tennessee Gas Pipeline Company, Lincolnshire, Ill.

[21] Appl. No.: 573,386

[22] Filed: Aug. 27, 1990

[51] Int. Cl.[5] ..... B21D 22/00

[52] U.S. Cl. ..... 29/890.08; 29/463; 60/323; 72/348

[58] Field of Search ..... 29/890.08, 463, DIG. 37; 60/323; 285/210, 286; 72/348

[56] References Cited

U.S. PATENT DOCUMENTS

| | | | |
|---|---|---|---|
| 1,417,395 | 5/1922 | Lassiter et al. | 285/286 |
| 1,417,396 | 5/1922 | Lassiter et al. | 285/286 |
| 1,425,495 | 8/1922 | Thom | 285/286 |
| 3,238,605 | 3/1966 | Hills . | |
| 3,944,261 | 3/1976 | Reed et al. | 29/890.08 |
| 4,022,019 | 5/1977 | Garcea | 29/890.08 |
| 4,131,007 | 12/1978 | Laundy | 72/348 |
| 4,621,494 | 11/1986 | Fujita | 60/323 |
| 4,655,035 | 4/1987 | Sager, Jr. | 60/307 |

FOREIGN PATENT DOCUMENTS

| | | | |
|---|---|---|---|
| 0154120 | 11/1981 | Japan | 29/890.08 |

*Primary Examiner*—Irene Cuda
*Attorney, Agent, or Firm*—Harness, Dickey & Pierce

[57] ABSTRACT

A collector apparatus for use in motor vehicle exhaust systems for connecting an internal combustion engine to a open-ended gas receiving member. The collector apparatus defines a chamber for receiving and thoroughly mixing exhaust gases delivered from opposite manifolds associated with the engine prior to delivery to the open end of the gas receiving member. The collector may be formed from a one-piece tubular housing or as a two-piece clam shell and a method for construction of each is disclosed.

9 Claims, 6 Drawing Sheets

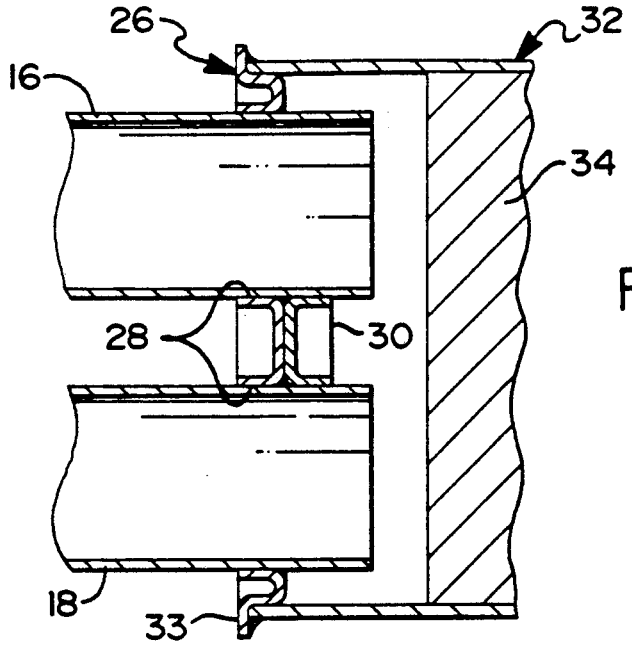
FIG 2
PRIOR ART
FIG 5
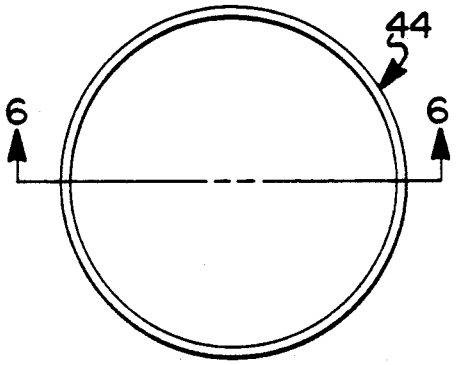
FIG 7
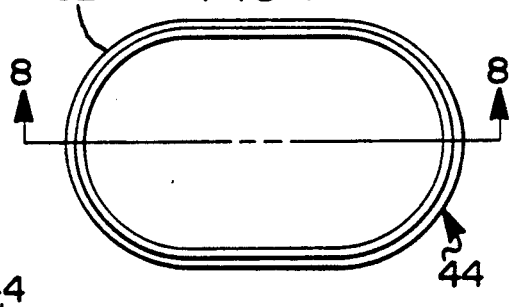
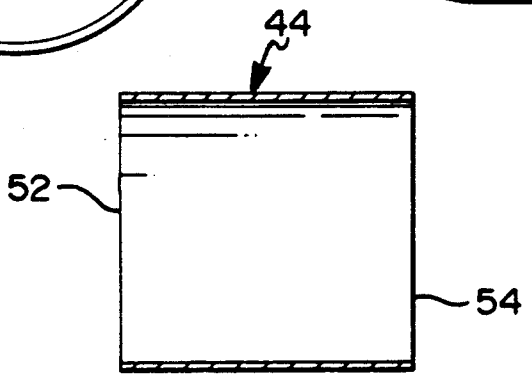
FIG 6
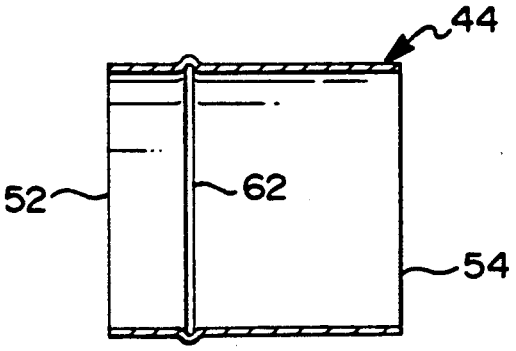
FIG 8

METHOD OF MAKING A COLLECTOR DEVICE

BACKGROUND AND SUMMARY OF THE INVENTION

This invention relates generally to the exhaust gas systems of internal combustion engines, particularly those used in automobiles and trucks and the like and, more particularly, to a collector device for connecting two exhaust pipes extending from the manifolds of the internal combustion engine to an open-ended gas receiving member such as a muffler or catalytic convertor. The present invention also relates to the method of making collectors of this type.

Six and eight cylinder internal combustion engines are typically equipped with separate exhaust manifolds, located on opposite sides of the engine, to carry away exhaust gases from the cylinders. It is known in the art to employ a Y-pipe to connect the two separate exhaust pipes extending from opposite manifolds to a single pipe for directing the exhaust gases to a gas receiving member such as a catalytic converter, muffler, or the like. Typically, the gas receiving member has an inlet end defined by a single passage adapted for connection to the single pipe. In this manner, the gases exhausted from the opposite manifolds are combined into a single exhaust passage prior to delivery into the inlet end of the gas receiving member. However, such Y-pipe configurations are not generally applicable to exhaust systems utilizing open-ended gas receiving members.

It is a purpose of this invention to provide an apparatus and method, useful in internal combustion engine applications, for joining two exhaust pipes extending from separate manifolds of the internal combustion engine to the open end of an open-ended exhaust gas receiving member such as a catalytic converter or a muffler. A further purpose of this invention is to provide an apparatus which will enhance thorough mixing of the separate exhaust gases prior to delivery to the gas receiving member.

In accordance with the present invention there is provided a collector for attaching two exhaust pipes to the open end of a gas receiving member. The collector receives the exhaust gases from the two pipes and allows the gases to thoroughly mix and therefore utilize substantially the entire cross-section of the gas receiving member for noise abatement and/or by-product treatment.

In accordance with the present invention, a collector is provided having a first open outlet end adapted to be coupled to an open-ended exhaust gas receiving member. The collector has a second inlet end defining first and second inlet openings adapted to receive the exhaust pipes extending from the manifolds. The collector is configured to form an internal chamber for combining and mixing the exhaust gases delivered from the two exhaust pipes prior to introduction into the open end of the gas receiving member. Preferably, the collector is welded to each of the pipes extending through the inlet openings. The open end of the collector has cross-section that is at least equal to or greater than the combined area of the inlet openings such that the creation of back pressure is minimized as the exhaust gases are combined.

According to a first preferred embodiment, the collector is a one-piece apparatus comprising a tubular shell having a longitudinal axis and a first end wall and a second end wall spaced along the axis. The specific configuration of the first end of the shell is adapted to be connectable to the gas receiving member. The second end wall is deformed into a shape adapted to be connectable to the exhaust pipes extending from the manifolds. Formed adjacent the first end wall is a annular rib which extends radially outward from the shell wall, which serves to control shell material flow during the forming of the second end wall and to restrain the cross-section of the shell against undesired distortion when the second end wall is deformed.

According to a second preferred embodiment of the present invention, a two-piece clam shell type collector is disclosed. The clam shell collector comprises two mirror image half shells which are configured to provide a large open end when the two shells are assembled that is adapted to be connected to an open-ended exhaust gas receiving member. The half shells are further configured, when assembled together, to receive inlet exhaust pipes extending from the dual manifolds as well as to define a single internal chamber for the mixing of the exhaust gases.

The present invention provides a collector apparatus (and method of making the same) of sufficient integrity and strength such that the joint between the two pipes extending from the dual exhaust manifolds of an internal combustion engine helps to maintain the structural integrity of the rest of the exhaust system. Further, the collector is one that enhances quality of construction and performance at realistic costs of manufacture.

Further objects and advantages, residing in the construction, arrangement and combination of features and structural parts of the collector will become apparent upon consideration of the following detailed descriptions with reference to the accompanying drawings and preferred embodiments.

RELATED APPLICATION

U.S. patent application Ser. No. 546919, filed Jul. 2, 1990, entitled ACOUSTIC MUFFLER WITH ONE-PIECE HOUSING, and assigned to the assignee of this application.

DESCRIPTION OF THE DRAWINGS

FIG. 2 is a top sectional view of a portion of the exhaust system of FIG. 1 illustrating the association of the exhaust pipes, an inlet cover and an inlet reinforcement relative to the open end of the gas receiving member;

FIG. 5 is a cross-section of a round cylindrical metal shell from which the collector of FIG. 4 may be formed;

FIG. 6 is a cross-section taken along line 6—6 of the cylindrical shell shown in FIG. 5;

FIG. 7 is an end view of the shell of FIG. 5 after it has been shaped into an oval with an outwardly projecting annular rib formed therein;

FIG. 8 is a cross-section taken along line 8—8 of FIG. 7;

DETAILED DESCRIPTION OF THE PREFERRED EMBODIMENTS

Figures 1, 3:
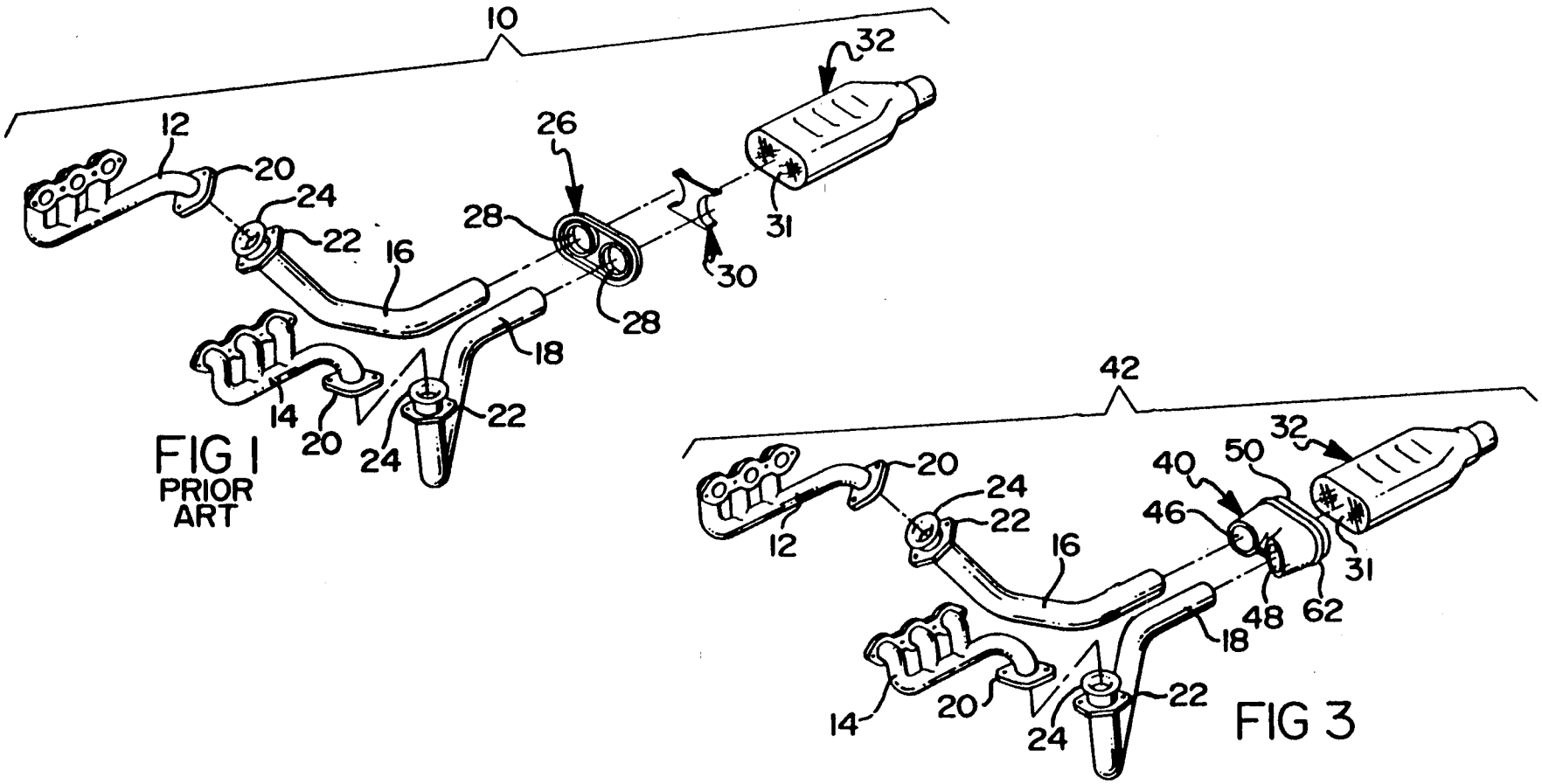
FIG 1 PRIOR ART
FIG. 1 is an exploded perspective view of a conventional or prior art motor vehicle internal combustion engine exhaust system having an open-ended gas receiving member.
FIG. 3 is an exploded perspective view of a motor vehicle exhaust system showing a one-piece collector according to a first preferred embodiment of the present invention.
Figure 4:
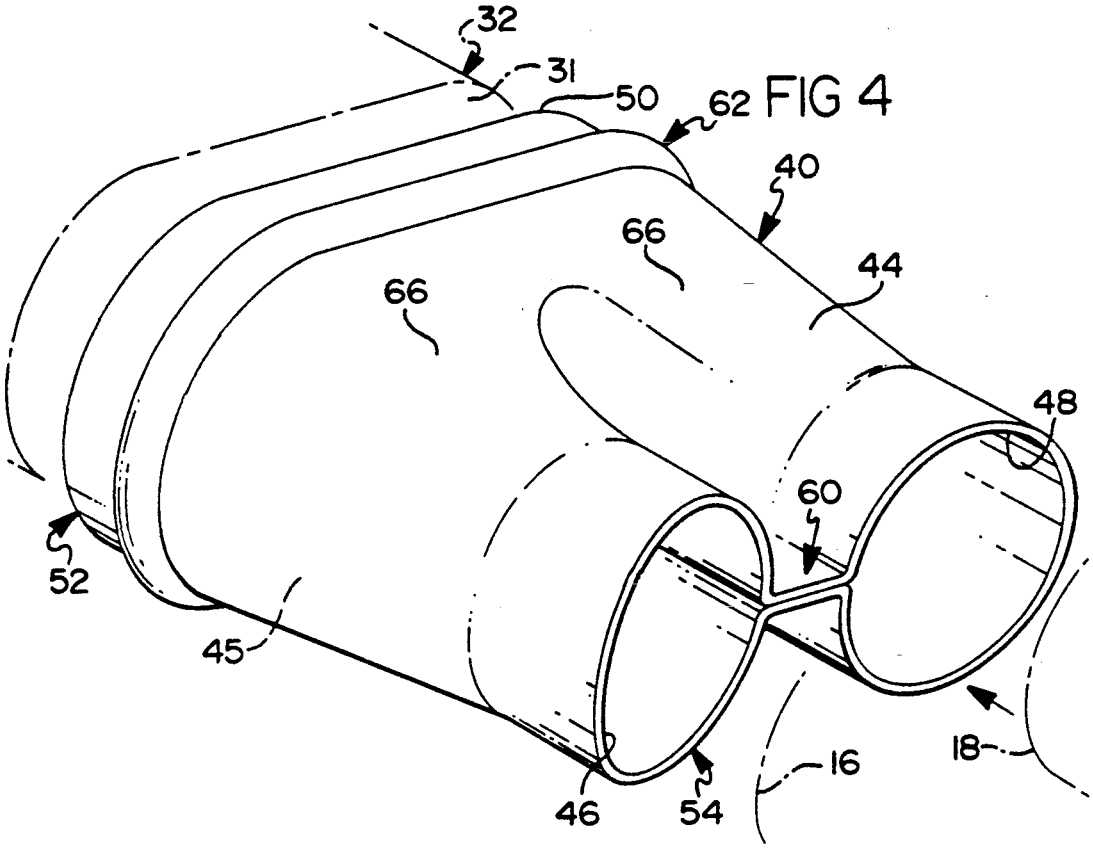
FIG. 4 is an enlarged perspective view of the collector shown in FIG. 3.
Figure 9:
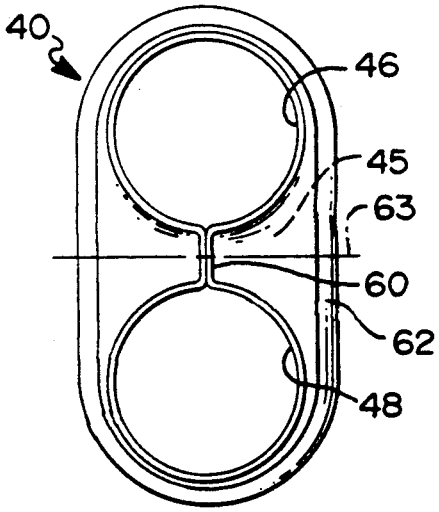
FIG. 9 is an end view of the collector shown in FIG. 4.
Figure 10:
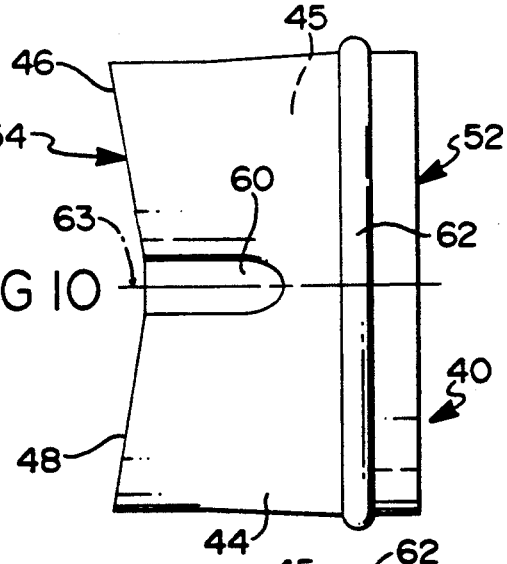
FIG. 10 is a top view of the collector shown in FIG. 4.
Figure 11:
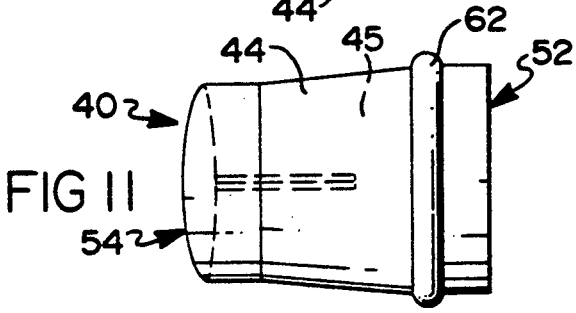
FIG. 11 is a side view of the collector shown in FIG. 4.

Referring to FIGS. 1 and 2, a conventional or prior art exhaust system adapted for exhausting gases and other by-products of an internal combustion engine of the type used in automobiles, trucks and the like is illustrated. Exhaust system 10 for a V-6 internal combustion engine includes manifolds 12 and 14 which extend from opposite sides of the engine to collect and transfer exhaust gases exiting the engine. Manifolds 12 and 14 are connected to a first end of separate exhaust pipes 16 and 18, respectively, by means of flange joining devices 20 and 22 and a seal 24 provided therebetween. Seal 24 inhibits leakage of exhaust gases through the joints defined by joining devices 20 and 22. The second end of exhaust pipes 16 and 18 is connected to an inlet cover 26 through apertures 28 which are configured to accept installation of exhaust pipes 16 and 18 therein. Generally, exhaust pipes 16 and 18 are rigidly welded to inlet cover 26. An inlet reinforcement 30 is also welded between a portion of exhaust pipes 16 and 18 extending through apertures 28 to provide additional system rigidity. Inlet cover 26 is thereafter secured, as by welding, to an open end 31 of an open-ended exhaust gas receiving member 32. Exhaust gas receiving member 32 can include a catalytic convertor, a muffler, or the like. As is shown in greater detail in FIG. 2, the open end of gas receiving member 32 is welded along its peripheral edge to a radial flange 33 provided on inlet cover 26. Likewise, inlet reinforcement 30 is welded (not shown) to inlet cover 26 and exhaust pipes 16 and 18.

A characteristic associated with conventional inlet covers 26 is that the exhaust gases from each individual pipe enter gas receiving member 32 in such a manner so as to directly impinge with substantial velocity on limited portions of the internal components thereof. Accordingly, the efficiency and useful life of gas receiving member 32 may be reduced by erosion and because the area of direct impingement is limited relative to the overall cross-section available. This characteristic is particularly noteworthy when gas receiving member 32 is a catalytic converter containing a catalytic ceramic monolith 34, or the like, for converting by-products of the exhaust gases.

In accordance with the present invention, an apparatus for connecting the dual manifold exhaust pipes of a "V" type internal combustion engine to the open end 31 of gas receiving member 32 is provided. The apparatus collects the exhaust gases delivered from separate exhaust pipes 16 and 18 thereby allowing the exhaust gases to thoroughly mix and to lose velocity prior to introduction into gas receiving member 32. The following description of the preferred embodiments in accordance with the drawings is exemplary in nature and is not intended to limit the present invention to the specific structure shown.

Referring to FIGS. 3-11, a first preferred embodiment of a collector 40 is shown. Collector 40 is utilized for connecting two exhaust pipes 16 and 18 of an internal combustion engine to the open end 31 of a gas receiving member 32, such as a muffler, catalytic convertor, or the like. In accordance with the present invention, collector 40 (FIG. 4) comprises a one-piece, tubular metal housing or shell 44 with integral first and second inlet passages 46 and 48 formed at one end and an integral outlet passage 50 formed at the opposite end. Thus, exhaust gases flow through collector 40 from inlet passages 46 and 48 to outlet passage 50 for introduction into gas receiving member 32.

Shell 44 is preferably one-piece and fabricated of any suitable metal such as low carbon or stainless steel that may be press formed or stamped to the desired shape and yet retain the strength and durability necessary in an exhaust gas system environment. Shell 44 has a longitudinal axis and opposite end walls 52 and 54 extending transversely to the longitudinal axis. At the inlet end 54 the tubular housing 44 is radially deformed and opposite sides are pinched together over shaping mandrels (not shown) to form the integral inlet passages 46 and 48 and the double metal layer joint or tab or flange 60 between the inlet passages. The tab 60 comprises a double thickness of metal which is preferably welded together along its peripheral edge to seal in fluid tight manner the inlet end 54 of housing 44 except for the formed inlet passages 46 and 48. The outlet end 52 of housing 44 remains oval-shaped (undeformed) to provide outlet passage 50 which is adapted to permit the open end 31 of gas receiving member 32 to be disposed thereover and welded thereto. Pinched-in end closures and inlets or outlets of this general type in exhaust apparatus are shown and described in patent application Ser. No 546919, filed Jul. 2, 1990, and owned by the assignee of the present invention.

Further, in accordance with this invention, shell 44 is provided with an annular rib 62 that is spaced longitudinally between end walls 52 and 54 adjacent end wall 52. Rib 62 serves to enhance the structural shape retaining capability of shell 44 when inlet end wall 54 is deformed in the pinching operation. Rib 62 provides tube flexibility at the adjacent end and seems to act as a source of metal that my be drawn into the end joint in lieu of undesired deformation elsewhere. Rib 62 further serves to limit the deformation run-out of shell 44 during the pinching step. Annular rib 62 is disposed in a respective plane transverse to the longitudinal axis of housing 44 and preferably extends radially outwardly from and around the entire outside of the housing 44. Rib 62, which is continuous to provide strength and rigidity to shell 44, is formed in shell 44 prior to radial deformation of end wall 54. Rib 62 may be formed while the shell tube is still in the flat metal condition.

In general, a collector used in automotive exhaust systems may be of round or other elliptical cross-section such as oval. The generally oval cross-section illustrated herein is ordinarily preferred for automotive exhaust systems because collector 40 can be shaped to occupy minimal vertical space beneath the vehicle. As illustrated in FIGS. 5 and 6, in making the collector 40 of this invention, it is expedient to start with commercially available round metal tubing of uniform diameter and metal thickness which is open at both ends. The tubing can be radially compressed from opposite sides with tubing dies (not shown) to form the oval shape. FIGS. 7 and 8 illustrate shell 44 after being formed into an oval shape and having outwardly extending annular rib 62 formed therein.

In use, collector 40 would normally be secured to exhaust system components 42 by welding or otherwise securely attaching exhaust inlet pipes 16 and 18 to inlet passages 46 and 48, respectively. While collector 40 is shown as symmetrical about a central vertical axis 63 through the center of pinched portion 60, it will be recognized that the structure and method described enables one or both inlet passages to be angularly offset from the axis. In this manner, variations in the angular orientation of inlet passages 46 and 48 may be provided by orienting the shaping mandrels (not shown) to the desired relative angularity therebetween.

According to the method of the present invention, after the rib 62 is formed in oval shell 44, a pair of appropriate sized mandrels are placed within an opening defined by the inlet end wall 54 of oval shell 44. Thereafter, forming dies (not shown) press opposite sides of the shell against the dies for shaping. It also presses the portions of inlet end wall 54 that are between the mandrels together to deform the inlet end wall 54 around the mandrels and form inlet apertures 46 and 48. This deformation step also forms generally frusto-conical sections 66 of decreasing diametrical cross-section, the sections 66 being laterally separated by the flattened portion of tab 60. After the deforming step is completed, the mandrels are removed and the metal layered joint of tab 60 is formed as the engaged portions of the shell are welded together to provide a fluid tight seam.

The space inside of collector 40 between oval-shaped outlet end wall 52 and the outlet ends of inlet passages 46 and 48 defines an interior expansion chamber 45. The tapered interior expansion chamber 45 permits mixture of exhaust gases delivered from the separate inlet passages 46 and 48 prior to introduction to the open end 31 of exhaust receiving member 32. Such premixture provides a generally turbulent, exhaust gas mixture which effectively utilizes a greater percentage of the cross-sectional area associated with open end 31 of gas receiving member 32 as compared to the previously described conventional system. Advantageously, the construction is believed to tend to minimize the creation of back pressure in the exhaust system when the collector 40 is utilized.

Referring to FIGS. 12 through 16, a second preferred embodiment of the present invention is illustrated in greater detail. In reference to FIG. 12, like numbers are used for designation of like components herebefore described in detail in FIGS. 1–11. Again, the structure illustrated is merely exemplary and is not intended to be limiting in scope.

In general, the second embodiment discloses a clam shell type collector 100 which provides substantially identical function and operation to that previously described in reference to the first preferred embodiment and which is shown in association with exhaust system 101. More particularly, clam shell type collector 100 generally has two half shells, a top half shell 102 and a bottom half shell 104. The half shells are preferably mirror images of one another and generally comprise two semi-circular openings for installation of exhaust pipes 16 and 18 therein, and a generally open end adapted for connection to the open end 31 of gas receiving member 32. When half shells 102 and 104 are assembled together, a generally tubular shaped collector device is formed that generally conforms with the tubular shape of pipes 16 and 18 and open end 31 of gas receiving member 32. More particularly, when half shells 102 and 104 are combined, generally circular inlet passages 106 and 108 are formed for receiving and enclosing in a fluid tight manner an end of exhaust pipes 16 and 18, respectively. Outlet passage 110 is adapted for receiving the open end 31 of gas receiving member 32. Intermediate the inlet and outlet end, an interior chamber 112 is defined for permitting generally homogeneous mixture of the exhaust gases received from tubes 16 and 18.

Generally, half shells 102 and 104 are joined together by suitable known welding techniques. While the two half shells 102 and 104 are illustrated with overlapping peripheral edge configuration 114, it will be appreciated that the two half shells 102 and 104 could alternatively be provided with a radially extending flange member extending along their peripheral edges for providing a contact and weld area between the two half shells. An example of such radially extending flange is shown and described in U.S. patent application Ser. No. 571/81, filed Aug. 23, 1990, entitled CLAM SHELL TYPE Y-JOINT, and owned by the assignee of the present invention.

Each of exhaust pipes 16 and 18 and gas receiving member 32 are welded within the passages 106, 108 and 110, respectively, of collector 100. Although it is possible to use other methods of joining the half shells 102 and 104 together and collector 100 to pipes 16, 18 and gas receiving member 32, welding provides a well known and highly effective method for this purpose to insure the strength and integrity of the exhaust system at the joining area.

The sizes of separate exhaust pipes 16 and 18 and inlet passages 106 and 108 may be configured in conjunction with the size of outlet passage 110 and gas receiving member 32 so that minimal back pressure is created in the exhaust gases when combining gases from the two exhaust pipes 16 and 18 in internal chamber 112. The half shells of collector 100 may be readily manufactured by press forming or stamping appropriate blanks of sheet metal.

Figure 13:
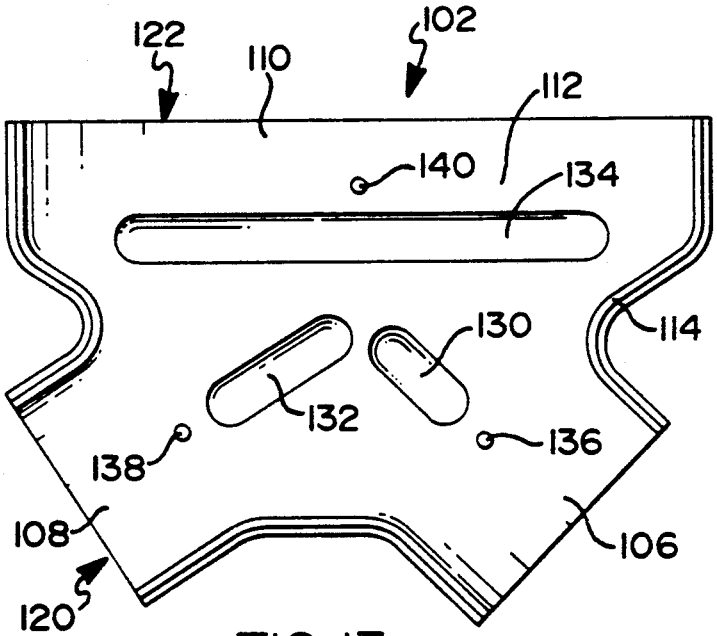
FIG. 13 is an inside view of half-shell 102 of the clam shell type collector according to the second preferred embodiment.
Figure 15:
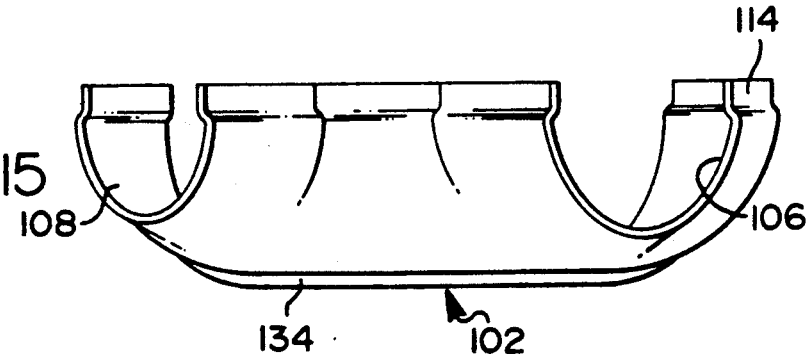
FIG. 15 is an end view of the inlet end of the half-shell of FIG. 13.

Referring to FIGS. 13 through 16, the features of the clam shell type collector 100 are further illustrated. FIG. 13 shows one of the half shells 102 of the clam shell type collector 100 viewed from the inside. It will be understood that the other half shell 104 is substantially identical to half portion 102 in a generally mirror image fashion. The peripheral edge of half shell 104, however, comprises the complimentary configuration to peripheral edge of half shell 102 so that the peripheral edge of each half shell overlaps the other. Half shell 102 of collector 100 has inlet end 120 and outlet end 122. Inlet end 120 combined with an inlet end of the other half shell 104 forms generally circular inlet passage 106. Angularly adjacent to inlet passage 106 is a second generally circular inlet passage 108, also associated with inlet end 120. As above, inlet passage 108 is formed by the combination of both half shells 102 and 104. Outlet end 122 combines with an outlet end of the other half shell 104 to form outlet passage 110. When half shells 102 and 104 are assembled to form collector 100, a single internal chamber 112 is formed therein.

Figure 12:
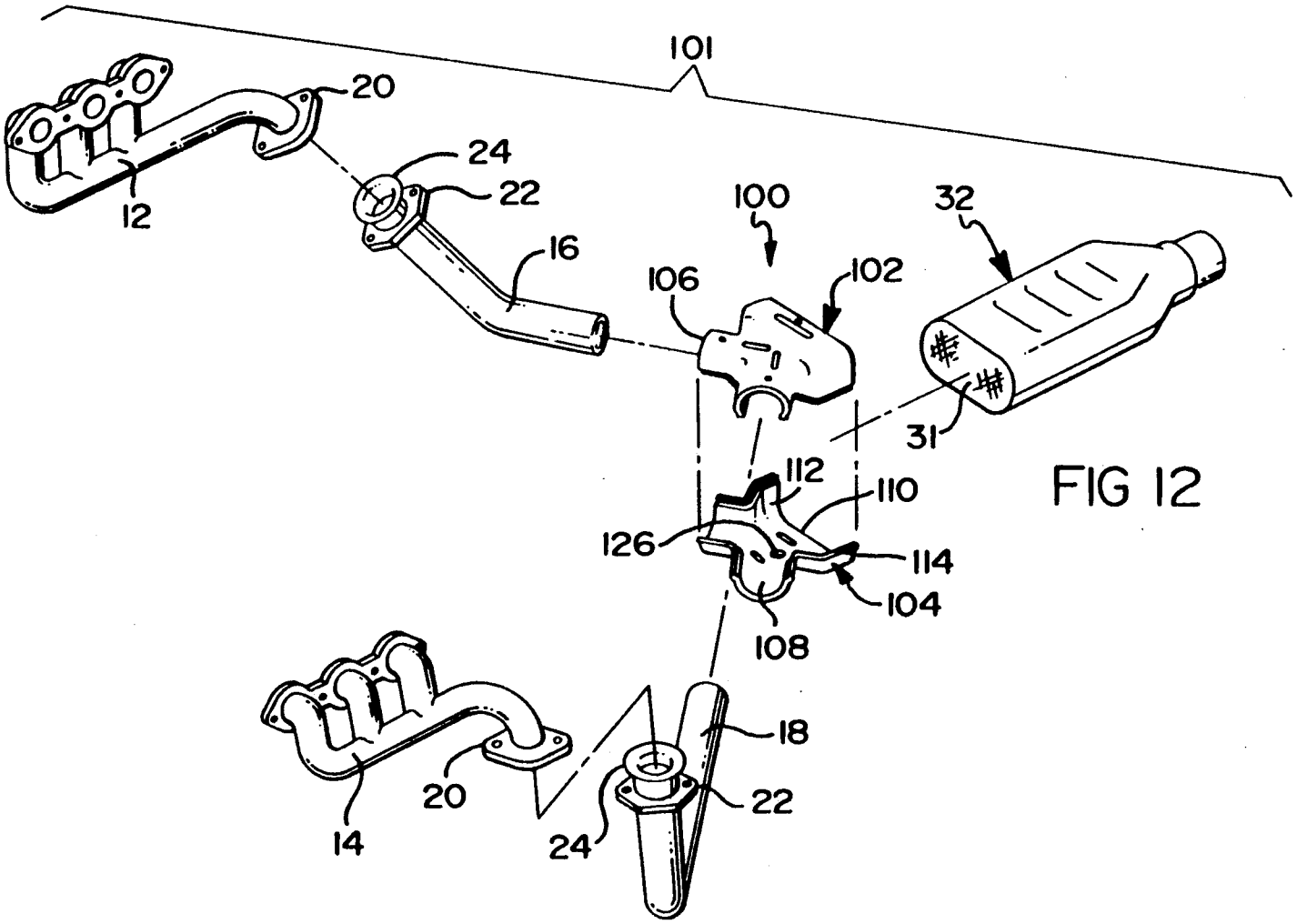
FIG. 12 is an exploded perspective view of a motor vehicle internal combustion engine exhaust system having a clam shell type collector device according to a second embodiment of the present invention.
Figure 12A:
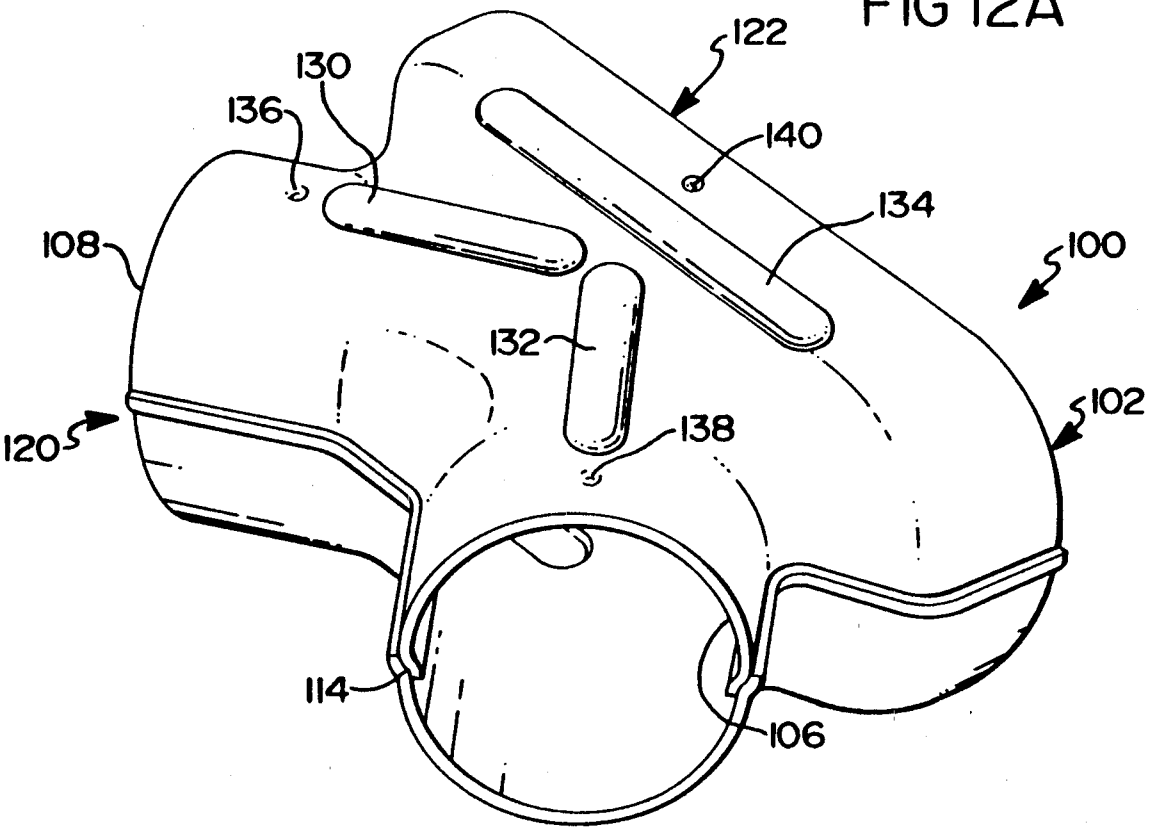
Figure 14:
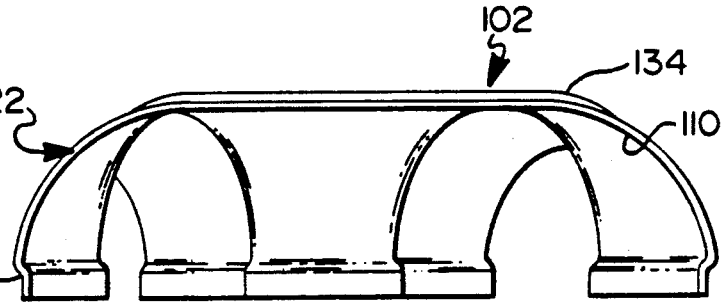
FIG. 14 is a end view of the outlet end of the half-shell of FIG. 13.
Figure 16:
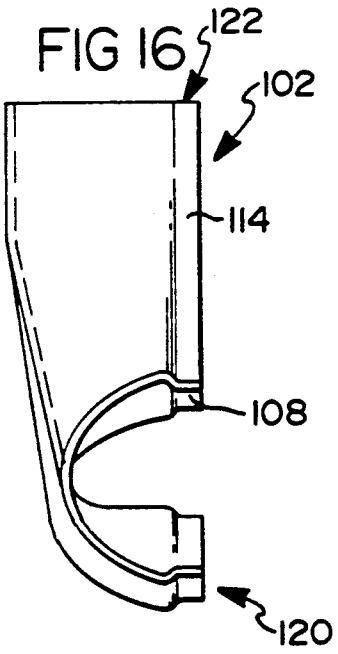
FIG. 16 is a side view of the half shell of FIG. 13.

Also shown in FIG. 12, an aperture 126 may be provided for introducing forced air into chamber 112. It will be appreciated that aperture 126 may be located in either half shell 102 or 104 at generally any location that accesses chamber 112. The supplemental air introduced through aperture 126 will combine with the flow of the exhaust gases and be carried to the catalytic converter to enhance conversion of the combustion by-products in the exhaust gases. Outwardly biased ribs 130, 132 and 134 may be provided respectively near passages 106, 108, and 110 in collector 100 to function to some degree as rib 62 in collector 40 as described above. Furthermore, inwardly biased dimples 136, 138, and 140 are likewise provided near passages 106, 108 and 110, respectively, in collector 100 to provide stop and positioning means to prevent the exhaust pipes 16, 18 and gas receiving member 32 from being inserted too far into the collector and interfering with the flow of exhaust gases through the collector.

Each half shell 102 and 104 may be made from any suitable metal such as low carbon steel or stainless steel that may be readily stamp formed and yet retain the strength and durability necessary in an exhaust gas system environment. Through conventional stamp forming techniques, the diameter of chamber 112 and passage 106 and 108 can be changed to accommodate different diameter exhaust pipes. In like manner, the length of chamber 112 as well as the overall length of collector 100 can be readily changed. All of the above changes can be made in conventional stamp forming operations by changing the tooling to provide different collectors according to this invention for different exhaust systems.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention.

What is claimed is:

1. A method of interconnecting two exhaust pipes extending from opposite manifolds of an internal combustion engine to an open end of a gas receiving member, said method including the steps of:

providing a collector device having an inlet end, an outlet end, and a chamber intermediate said inlet and outlet ends by reforming a cylindrical sheet of metal into a one-piece tubular shell having a longitudinal axis, and a first end wall and a second end wall spaced along said longitudinal axis, forming an outwardly extending annular rib into said shell adjacent said second end wall, and deforming said first end wall in a direction transverse to said longitudinal axis by forcing material of said first end wall into a predetermined shape to define first and second inlet passages and a closure portion therebetween for connection to said exhaust pipes;

positioning an end portion of each of said two exhaust pipes into said first and second inlet passages associated with said inlet end of said collector device;

positioning said open end of said gas receiving member into an outlet passage associated with said outlet end of said collector device; and securing said collector device to said two exhaust pipes and said gas receiving member, said chamber allowing generally homogeneous mixing of exhaust gases entering said first and second inlet passages prior to delivery to said open end of said gas receiving member.

2. The method of claim 1 further including the step of providing an aperture in said chamber of said collector for introducing air therein.

3. The method of claim 1 wherein said shell has an elliptical cross-section.

4. The method of claim 1 comprising the step of inserting mandrels having a shaped cross-section into said first end wall, positioning said mandrels prior to the deforming step, and removing said mandrels from said shell following said deforming step.

5. The method of claim 4 wherein said deforming step flattens a length of said first end wall located between said first and second inlet passages into a common plane with said longitudinal axis of said shell.

6. A method of making a collector for connecting the exhaust system of a combustion engine to a gas receiving member such as a catalytic converter of muffler, comprising the steps of reforming a cylindrical sheet of metal into a tubular shell having a first end wall and a second end wall spaced along a longitudinal axis, forming a radial rib in said shell at a location between said end walls, and deforming said first end wall by forcing the material thereof into a predetermined shape for connection to said exhaust system.

7. The method of claim 6 wherein said rib is formed to extend radially outwardly from and substantially completely around said shell.

8. The method of claim 6 further comprising the step of inserting a mandrel having a shaped cross-section into said first end wall at a predetermined position prior to said deforming step and removing said mandrel from said shell following said deforming step, whereby said mandrel cooperates with said first end wall material during said deforming step to provide said predetermined shape.

9. The method of claim 6, wherein said shell has a substantially elliptical cross-section.

* * * * *

UNITED STATES PATENT AND TRADEMARK OFFICE

CERTIFICATE OF CORRECTION

PATENT NO. : 5,148,597

DATED : September 22, 1992

INVENTOR(S) : Andrew M. Weeks

It is certified that error appears in the above-identified patent and that said Letters Patent is hereby corrected as shown below:

Column 4, line 54, "my" should be --may--.

Column 6, line 28, "Ser. No. 571/81" should be --Ser. No. 571,181--.

Column 8, Line 34, Claim 6, "of" should be --or--.

Signed and Sealed this

Twenty-first Day of September, 1993

Bruce Lehman

*Attest:*

BRUCE LEHMAN

*Attesting Officer*

*Commissioner of Patents and Trademarks*